US006739685B2

(12) United States Patent
Aiba

(10) Patent No.: US 6,739,685 B2
(45) Date of Patent: May 25, 2004

(54) INK-JET HEAD CONTROL METHOD AND INK-JET PRINTER

(75) Inventor: Masahiko Aiba, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/285,579

(22) Filed: Nov. 1, 2002

(65) Prior Publication Data

US 2003/0085935 A1 May 8, 2003

(30) Foreign Application Priority Data

Nov. 2, 2001 (JP) ..... 2001-338022

(51) Int. Cl.[7] ..... B41J 29/38
(52) U.S. Cl. ..... 347/10; 347/14
(58) Field of Search ..... 347/9, 10, 14, 347/17, 60

(56) References Cited

U.S. PATENT DOCUMENTS

2002/0140752 A1 * 10/2002 Pulman et al. ..... 347/10

* cited by examiner

*Primary Examiner*—Michael S. Brooke
(74) *Attorney, Agent, or Firm*—Birch, Stewart, Kolasch & Birch, LLP

(57) ABSTRACT

An ink jet printing apparatus and method for forming images by selectively actuating a multiple number of ink chambers. An amount of energy U0, which is determined by U0=Ui−Ud, is applied to each non-ejecting chamber, wherein Ui is the energy imparted to each ejecting chamber and Ud is the energy that is carried away by a single droplet of ink, when all the nozzles are driven to eject ink at a maximum ejection ratio, with the temperature rise of ink jet head being saturated.

6 Claims, 4 Drawing Sheets

FIG. 4A

| Ejection ratio FR(%) | Input power Pi(W) | Dot calorie Wd(W) | Discharged heat quantity Wf(W) | Temperature rise ΔT(deg) |
|---|---|---|---|---|
| 0 | 1.30 | 0 | 1.3 | 19.5 |
| 10 | 1.67 | 0.37 | 1.29 | 19.5 |
| 20 | 2.04 | 0.74 | 1.29 | 19.5 |
| 30 | 2.41 | 1.11 | 1.29 | 19.5 |
| 40 | 2.78 | 1.48 | 1.29 | 19.5 |
| 50 | 3.15 | 1.85 | 1.29 | 19.5 |
| 60 | 3.52 | 2.22 | 1.29 | 19.5 |
| 70 | 3.89 | 2.59 | 1.29 | 19.4 |
| 80 | 4.26 | 2.96 | 1.29 | 19.4 |
| 90 | 4.63 | 3.33 | 1.29 | 19.4 |
| 100 | 5.00 | 3.71 | 1.29 | 19.4 |

FIG. 4B

CONVENTIONAL ART

| Ejection ratio FR(%) | Input power Pi(W) | Dot calorie Wd(W) | Discharged heat quantity Wf(W) | Temperature rise ΔT(deg) |
|---|---|---|---|---|
| 0 | 0.0 | 0 | 0 | 0 |
| 10 | 0.5 | 0.11 | 0.39 | 5.8 |
| 20 | 1.0 | 0.36 | 0.64 | 9.5 |
| 30 | 1.5 | 0.69 | 0.81 | 12.1 |
| 40 | 2.0 | 1.07 | 0.93 | 14.0 |
| 50 | 2.5 | 1.47 | 1.03 | 15.4 |
| 60 | 3.0 | 1.89 | 1.11 | 16.6 |
| 70 | 3.5 | 2.33 | 1.17 | 17.5 |
| 80 | 4.0 | 2.78 | 1.22 | 18.3 |
| 90 | 4.5 | 3.24 | 1.26 | 18.9 |
| 100 | 5.0 | 3.70 | 1.30 | 19.4 |

FIG. 4C

| Ejection ratio FR(%) | Input power Pi(W) | Dot calorie Wd(W) | Discharged heat quantity Wf(W) | Temperature rise ΔT(deg) |
|---|---|---|---|---|
| 0 | 5 | 0.0 | 5 | 75.0 |
| 10 | 5 | 1.11 | 3.88 | 58.3 |
| 20 | 5 | 1.81 | 3.18 | 47.7 |
| 30 | 5 | 2.30 | 2.69 | 40.3 |
| 40 | 5 | 2.66 | 2.33 | 34.9 |
| 50 | 5 | 2.94 | 2.05 | 30.8 |
| 60 | 5 | 3.15 | 1.84 | 27.6 |
| 70 | 5 | 3.33 | 1.66 | 24.9 |
| 80 | 5 | 3.47 | 1.52 | 22.8 |
| 90 | 5 | 3.60 | 1.39 | 20.9 |
| 100 | 5 | 3.70 | 1.29 | 19.4 |

INK-JET HEAD CONTROL METHOD AND INK-JET PRINTER

This nonprovisional application claims priority under 35 U.S.C. §119(a) on Patent Application No. 2001-338022 filed in JAPAN on Nov. 2, 2001, which is herein incorporated by reference.

BACKGROUND OF THE INVENTION (1) Field of the Invention

The present invention relates to a control method of causing an ink-jet head to eject ink by imparting energy to each of multiple ink chambers arranged adjoining the ink-jet head in accordance with image data as well as relating to an ink-jet printer for printing images using this control method.

(2) Description of the Prior Art

An ink-jet printer is a printer which prints images on recording media such as paper etc., by ejecting ink selectively from multiple ink chambers arranged adjoining an ink-jet head in accordance with image data, and is typically constructed such that, while a carriage having an ink-jet head mounted thereon is moved in the main scan direction perpendicular to the direction of conveyance of recording media, energy for causing ink to eject is applied to each of the ink chambers in accordance with image data. Such ink-jet heads can be categorized into two types, i.e., the thermal type which ejects ink by heating ink charged in ink chambers and the piezoelectric type which ejects ink by changing the volumes of ink chambers that hold ink therein.

The characteristics of a liquid ink used for image printing in ink-jet printers, such as viscosity and the like, are known to affect the ejection performance of ink from the ink chambers, having significant influence on the image forming conditions on the recording media and presenting sharp fluctuations depending on change in temperature. Therefore, to keep good print conditions of images on the recording sheet, temperature control of the ink-jet head is important.

Particularly, in thermal type ink-jet printers, since electric energy is imparted to each ink chamber of the ink-jet head and converted into thermal energy so as to heat the ink charged in the ink chamber, the ink ejection performance is liable to vary due to temperature rise of the whole ink-jet head. In addition to this, among the multiple ink chambers, some may be imparted with electric energy to eject ink, others may be imparted with no electric energy so as not to eject ink, resultantly a large difference in temperature occurs and hence produces fluctuations in ink ejection performance between the ejecting ink chambers and the non-ejecting ink chambers, lowering the image quality of printed images.

On the contrary, in piezoelectric type ink-jet printers in which piezoelectric elements are used to convert electric energy into mechanical energy so as to change the volumes of ink chambers, problems due to heat generation upon ink ejections, inherently, occur less often. However, among piezoelectric type ink-jet printers, there is a type that implements a so-called multi-drop printing process in which the tone of each pixel in the image is reproduced by up to seven serial ejections of ink as a maximum, for example, or with seven droplets of ink. With this type of ink-jet printer, as the frequency of electric energy applied to the ejecting ink chambers increases, generation of heat in the piezoelectric elements due to their deformation increases, hence causing the same problem as the thermal type ink-jet printers suffer, that is, temperature rise of the whole ink-jet head and increase in temperature difference between the ejecting ink chambers and the non-ejecting ink chambers, hence causing degradation of the image quality of printed images.

As a conventional ink-jet printer to deal with the above problems, Japanese Patent Application Laid-open Hei 3 No.246049 discloses a thermal type ink-jet printer configuration in which a certain amount of energy which will not cause ink ejection is applied to each of the non-ejecting ink chambers at the same time ink is ejected from ejecting ink chambers, so as to reduce the difference in ink temperature between the ejecting ink chambers and the non-ejecting ink chambers, keeping ink ejection performance uniform and preventing degradation of the image quality of printed images.

As another conventional example, Japanese Patent Application Disclosure Hei 11-511410 discloses a piezoelectric type ink-jet printer configuration in which drive pulses for heating are applied to each of non-ejecting ink chambers at the same time ink is ejected from ejecting ink chambers, so as to equalize the amount of heat generation from each ejecting ink chamber with that from each non-ejecting ink chamber, thereby keeping ink ejection performance uniform and preventing degradation of the image quality of printed images.

However, none of the conventional ink-jet printers including those disclosed in Japanese Patent Application Laid-open Hei 3 No.246049 and those disclosed in Japanese Patent Application Disclosure Hei 11-511410 have been manipulated so that when ink is ejected from the ink head, a specific amount of energy that can cause a temperature rise of the ink in the non-ejecting ink chambers equal to that of ink in the ejecting ink chambers can be imparted to each non-ejecting ink chamber. Therefore, in the conventional ink-jet heads, though energy is applied to each non-ejecting ink chamber at the same time ink is ejected from ejecting ink chambers, the temperatures of ink in all the ink chambers do not necessarily become equal, one to another, hence there still remains the problem of failure in reliably preventing the degradation of the image quality of printed images by uniformizing the ink ejection performance of all the ink chambers.

In sum, the ink in the ejecting ink chamber rises in temperature upon ejection of ink as it is heated by the difference between the quantity of heat generated by the input of energy for ejection and the quantity of heat carried away when the droplets of ink are ejected from the ejecting ink chamber. Accordingly, in order to cause ink in non-ejecting ink chambers to increase in temperature upon ejection of ink as much as the ink in the ejecting ink chambers and in order to make the ink in all the ink chambers arranged in the ink head substantially uniform in temperature, energy equivalent to the difference between the input of energy imparted to the ejection chamber and the quantity of energy carried away by the ink droplet should be imparted to each of the non-ejecting ink chambers.

SUMMARY OF THE INVENTION

It is therefore an object of the present invention to provide a control method of an ink-jet head and an ink-jet printer with the ink-jet head, wherein, upon ejection of ink, an amount of energy, the difference obtained by subtracting the energy carried away by ejected ink droplets that are ejected to the outside, from the energy imparted to each ejecting ink chamber, can be imparted to each of the non-ejecting ink chambers, so that the temperature of ink charged in the ejecting ink chambers and the temperature of ink charged in the non-ejecting ink chambers will be equal, and, upon ejection of ink, the ink in non-ejecting ink chambers is elevated in temperature as much as the increase in temperature of the ink in ejecting ink chambers, whereby it is possible to make the ink ejection performance as to all ink chambers provided for the ink-jet head substantially uniform and positively prevent degradation of the image quality of printed images.

In order to achieve the above described object, the present invention is configured as follows.

In accordance with the first aspect of the present invention, a method of controlling an ink-jet head having a multiple number of ink chambers arranged adjacent thereto for forming images by selectively imparting energy to each of the ink chambers in accordance with image data so as to cause ink charged in the ink chambers to eject, is characterized in that an amount of energy U0, which is determined by $$U0=Ui-Ud,$$

is imparted to each of non-ejecting ink chambers for one ink ejection cycle, where Ui is the energy to be imparted to each ejecting ink chamber that ejects ink, every ink ejection cycle, among the multiple ink chambers, and Ud is the energy that is carried away by a single droplet of ink that is ejected to the outside when all the nozzles are driven to eject ink at the maximum ejection ratio with the temperature rise of the ink-jet head saturated.

In this configuration, upon ejection of ink from ejecting ink chambers to print an image, an amount of energy U0, the difference obtained by subtracting energy Ud carried away by one ejected ink droplet from energy Ui imparted to each ejecting ink chamber, is imparted to each of the non-ejecting ink chambers. Accordingly, the energy U0 equal to the energy (Ui−Ud) consumed to heat ink in each ejecting ink chamber is imparted to each non-ejecting ink chamber when an action of ejection is made, so that ink inside the non-ejection chambers can be elevated in temperature as much as the increase in temperature inside the ejecting ink chambers, whereby the ink ejection performance as to all ink chambers provided for the ink-jet head can be made uniform no matter whether ink is ejected or not upon actions of ink ejection.

Here, the kinetic energy, surface energy and the energy consumed due ink viscosity of the ink droplets ejected from the ejecting ink chambers are sufficiently small compared to the energy used for generation of heat in the ejecting ink chambers and hence can be neglected.

The method of controlling an ink-jet head in accordance with the second aspect of the present invention, is characterized in that the energy U0 can be determined as $$U0\approx WF/(1+C\cdot\gamma\cdot V\cdot Rt)/N,$$

and is imparted to each non-ejecting ink chamber every time ink is ejected from the ejecting ink chambers, where WF(W) is the input electric power when all ink chambers are caused to eject ink so that N ink droplets are ejected every second from the entire ink-jet head, C(J/(g·deg)) is the specific heat of the ink, γ(g/cc) is the specific weight of ink, V(cc/sec) is the amount of ejected ink and Rt(deg/W) is the heat resistance of the ink-jet head including radiator parts.

In this configuration, when a volume V(cc/sec) of ink having a specific heat of C(J/(g·deg)) and a specific weight of γ(g/cc) is ejected from all ink chambers provided for an ink-jet head presenting a heat resistance Rt(deg/W) as a self-heat releasing performance to the outside air, N droplets of ink are ejected every second from the whole ink-jet head (N is the product of the total number n of ink chambers in the ink-jet head and the ejection frequency f of ink droplets). In this case, an amount of energy U0, which is determined by $$U0\approx WF/(1+C\cdot\gamma\cdot V\cdot Rt)/N,$$

where WF(W) is the input electric power, is imparted to each non-ejecting ink chamber every time one ink ejection cycle is made. Accordingly, the energy to be imparted to each non-ejecting ink chamber upon an action of ink ejection can be optimized in terms of heat balance, based on the power consumption and the total number of ink droplets ejected for one second when all the ink chambers provided for the ink-jet head are caused to eject ink. As a result, the ink ejection performance in all ink chambers provided for the ink-jet head, can be kept substantially uniform no matter whether ink is ejected or not, when ink is ejected.

The method of controlling an ink-jet head according to the third aspect of the present invention is characterized in that the ink-jet head comprises a thermal type ink-jet head which ejects ink by converting the electric energy input to each ink chamber into thermal energy.

In the configuration which uses a thermal type ink-jet head, though a large temperature difference is liable to arise between the ejecting ink chambers and the non-ejecting ink chambers since ink is ejected by imparting electric energy to each ink chamber of the ink-jet head and converting it into thermal energy so as to heat the ink charged in the ink chamber, an amount of heat energy equal to the heat energy used for heating ink in the ejecting ink chamber upon an action of ink ejection, is imparted to each non-ejecting ink chamber. Accordingly, it is possible to increase the temperature of the ink in each non-ejecting ink chamber as much as the ink in ejecting ink chambers, whereby the ink ejection performance in all ink chambers provided for the ink-jet head, can be kept substantially uniform no matter whether ink is ejected or not, when ink is ejected.

The method of controlling an ink-jet head according to the fourth aspect of the present invention is characterized in that the ink-jet head comprises a piezoelectric type ink-jet head which ejects ink by converting the electric energy input to each ink chamber into mechanical energy.

In this configuration which uses a piezoelectric type ink-jet head, though heat is generated by deformation of piezoelectric elements since electric energy imparted to each ink chamber is converted into mechanical energy so as to change the volumes of the ink chambers by deformation of the piezoelectric elements, an amount of energy equal to the energy which will cause a temperature rise of the piezoelectric element in each ejection chamber upon an action of ink ejection, is imparted to each non-ejecting ink chamber. Accordingly, it is possible to cause the piezoelectric element in each non-ejecting ink chamber to generate as much heat as the piezoelectric element provided in each ejecting ink chamber does, hence it is possible to heat the ink in each non-ejecting ink chamber in an equivalent way to the way in which the ink in each ejecting ink chamber is heated, whereby the ink ejection performance in all ink chambers provided for the ink-jet head, can be kept substantially uniform no matter whether ink is ejected or not, when ink is ejected.

The method of controlling an ink-jet head according to the fifth aspect of the present invention is characterized in that drive energy is imparted to the ink chambers a number of times, up the specified maximum number, in accordance with image density data, during one cycle of a series of ink droplets.

In a so-called multi-drop type ink-jet head, a remarkable temperature difference in ink temperature between the ejecting ink chambers and the non-ejecting ink chambers upon ejection of ink is liable to occur because energy imparted to the ejection ink chambers is applied in a relatively high frequency in order for each pixel in the image to be reproduced by an ink droplet group, consisting of a single or multiple ink droplets, up to the predetermined maximum number, in accordance with image density data. In the configuration of the present invention, an amount of energy equal to the energy used for heating ink in the ejecting ink chamber upon an action of ink ejection, is imparted to each non-ejecting ink chamber. Accordingly, even with a multi-drop type ink-jet head, the difference in temperature between the ejecting ink chambers and the non-ejecting ink chambers upon actions of ink ejection will never become too much.

The sixth aspect of the present invention resides in an ink-jet printer comprising a controller, which controls an ink-jet head having a multiple number of ink chambers arranged adjacent thereto for forming images by selectively imparting energy to each of the ink chambers in accordance with image data so as to cause ink charged in the ink chambers to eject, and which implements a control method whereby an amount of energy U0, which is determined by $$U0=Ui-Ud,$$

is imparted to each of non-ejecting ink chambers for one ink ejection cycle, where Ui is the energy to be imparted to each ejecting ink chamber that ejects ink, every ink ejection cycle, among the multiple ink chambers, and Ud is the energy that is carried away by a single droplet of ink that is ejected to the outside when all the nozzles are driven to eject ink at the maximum ejection ratio with the temperature rise of the ink-jet head saturated.

In this configuration, when, among the multiple ink chambers arranged adjoining an ink-jet head, energy is imparted to ejecting ink chambers selected in accordance with image data, an amount of energy U0, the difference obtained by subtracting energy Ud carried away by the ejected ink droplet from energy Ui imparted to each ejecting ink chamber, is imparted to each of the non-ejecting ink chambers other than the ejecting ink chambers. Accordingly, the energy U0 equal to the energy (Ui−Ud) consumed to heat ink in each ejecting ink chamber is imparted to each non-ejecting ink chamber when an action of ejection is made, so that ink inside the non-ejection chambers can be elevated in temperature as much as the increase in temperature inside the ejecting ink chambers, whereby it is possible to make the ink ejection performance, as to all ink chambers provided for the ink-jet head, uniform, and hence keep good image forming conditions.

BRIEF DESCRIPTION OF THE DRAWINGS

FIGS. 4A, 4B and 4C are charts for explaining the control method of an ink-jet head and the way the temperature of ink rises in an ink-jet printer according to the embodiment of the present invention, in comparison with other control methods; and, FIGS. 5A, 5B and 5C are charts for explaining the way the temperature of ink rises in an ink-jet printer according to the embodiment of the present invention, in comparison with other control methods.

DESCRIPTION OF THE PREFERRED EMBODIMENTS

Figure 1:
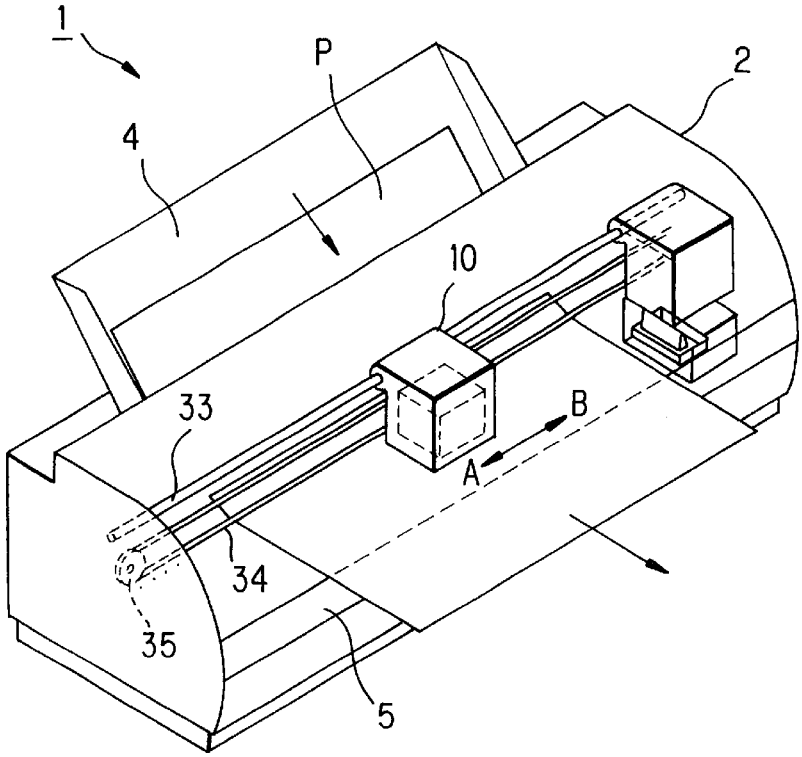
FIG. 1 is a perspective view showing an ink-jet printer in accordance with the embodiment of the present invention.
Figure 2:
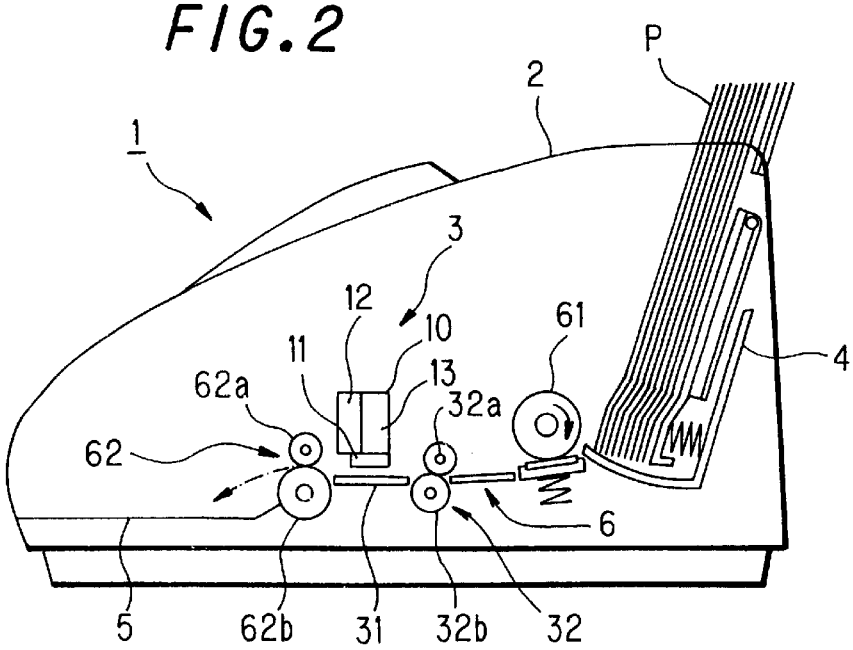
FIG. 2 is a schematic sectional side view showing the same ink-jet printer.

FIG. 1 is a perspective view showing an ink-jet printer in accordance with the embodiment of the present invention, and FIG. 2 is a schematic sectional side view showing the same ink-jet printer. An ink-jet printer 1 comprises: a printer housing 2; a printer assembly 3 arranged in the center of the housing; a paper feed tray 4 disposed on the rear side; and a paper output tray 5 disposed on the front side, and a paper feed path 6 is formed from paper feed tray 4 to paper output tray 5 by way of printer assembly 3.

Printer assembly 3 is comprised of a platen plate 31 constituting part of paper feed path 6, registration rollers 32 (32*a*, 32*b*), a guide shaft 33, a drive belt 34 and a carriage 10. Mounted on carriage 10 are an ink-jet head 11, a heat sink 12 and an ink tank 13. Carriage 10 is externally fitted on guide shaft 33. Further, part of drive belt 34 that is tensioned on a pulley 35 fixed to the rotary shaft of an unillustrated carriage motor is fixed to carriage 10. The normal and reverse rotations of the carriage motor are transferred to carriage 10 via pulley 35 and drive belt 34, as the force for moving the carriage along the main scan directions shown by arrows A and B. With this arrangement, carriage 10 reciprocates in the main scan directions along guide shaft 33.

Ink tank 13 holds liquid ink and is removably mounted on carriage 10. Heat sink 12 radiates heat generated from ink-jet head 11 and an aftermentioned driver IC to the air. Ink-jet head 11 is constructed with piezoelectric material, and has multiple nozzles spaced a predetermined distance away from, and opposing, platen plate 31 and multiple ink chambers communicating with the individual nozzles. For all the ink chambers, electrodes electrically connected to the driver IC are provided. In ink-jet head 11, drive voltages in accordance with image data are selectively applied to these electrodes by the driver IC to create deformations in the piezoelectric elements. Each deformation varies the volume of the ink chamber and ejects a droplet of ink, which is supplied from ink tank 13 to the ink chamber, onto the surface of paper P located between its nozzle and platen plate 31.

Provided along paper feed path 6 is a paper feed roller 61 axially supported on the paper feed tray 4 side and a pair of paper discharge rollers 62 (62*a*, 62*b*) on the paper output tray 5 side. Paper feed roller 61 delivers paper P, sheet by sheet, from the stack of paper on paper feed tray 4 to paper feed path 6. The thus fed paper P halts with its leading edge abutted against registration rollers 32 (32*a*, 32*b*). The registration rollers 32 start rotating at a predetermined timing so as to lead the fed paper P into the nip between ink-jet head 11 and platen plate 31 in printer assembly 3. Paper discharge rollers 62 continuously convey the paper P having been processed through printer assembly 3, bit by bit, to paper output tray 5. This paper feed roller 61, registration rollers 32 and paper discharge rollers 62 are driven to rotate by an unillustrated paper conveying motor or motors via appropriate clutches.

Figure 3:
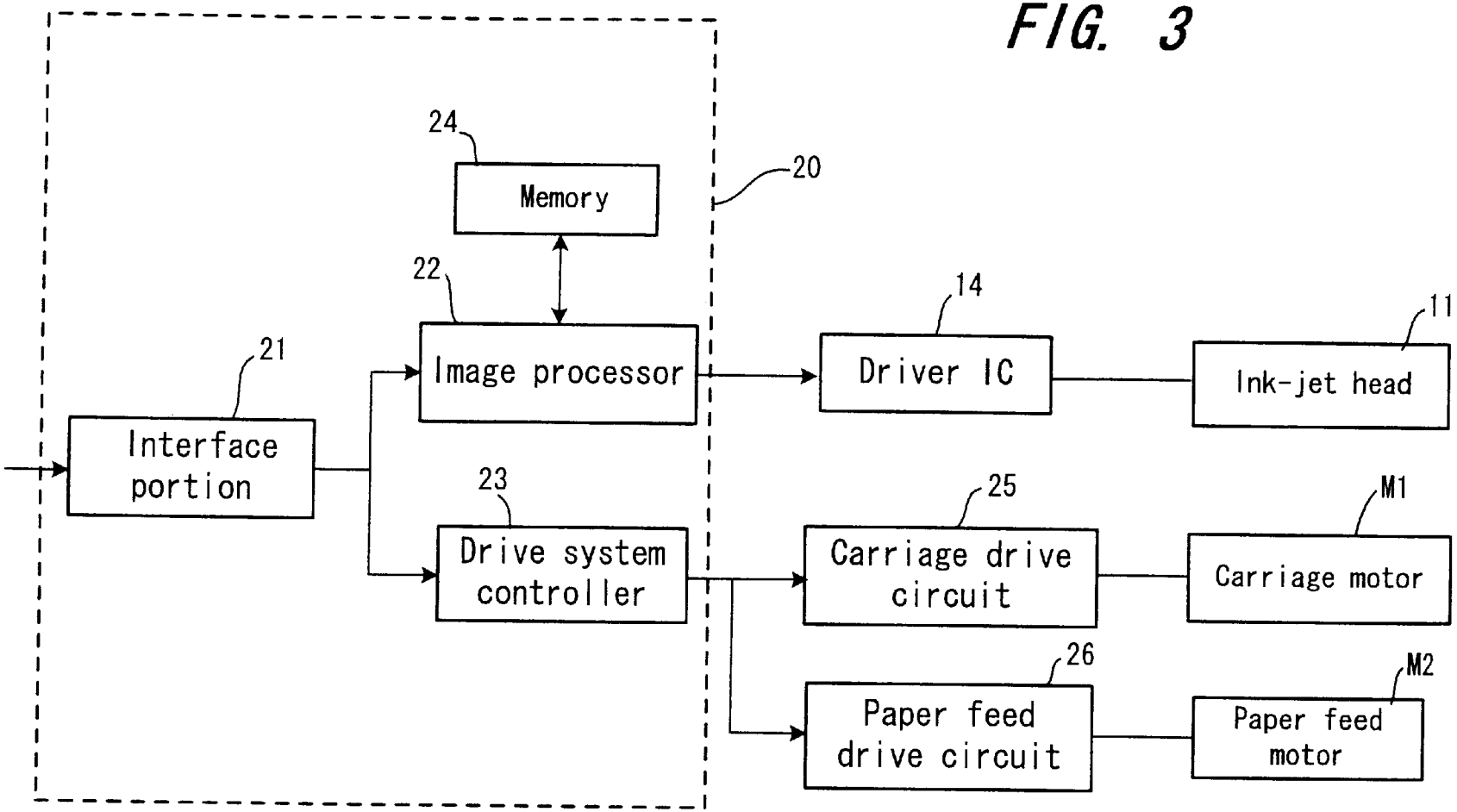
FIG. 3 is a block diagram showing the configuration of a controller of the ink-jet printer.

FIG. 3 is a block diagram showing the configuration of a controller of the above ink-jet printer. A controller 20 of ink-jet printer 1 is configured of a one-chip microcomputer, for example, including an interface portion 21, an image processor 22, a drive system controller 23 and a memory 24. Interface portion 21 functions to receive image data from external devices such as personal computers, scanners and the like. Image processor 22 implements predetermined image processes over the image data input through interface portion 21, temporarily stores the data into memory 24 and supplies it to driver IC 14 connected to ink-jet head 11. Drive system controller 23, based on a print command input together with the image data, outputs control data to a carriage drive circuit 25 and a paper feed drive circuit 26.

The driver IC, based on the image data output from image processor 22, selectively applies drive voltages to the electrodes formed in the ink chambers of ink-jet head 11. Carriage drive circuit 25 and paper feed drive circuit 26, based on the control data output from drive system controller 23, outputs drive signals to a carriage motor M1 and a paper feed motor M2. Here, if there are clutches and other components for the rollers within paper feed path 6, paper feed drive circuit 26 also outputs drive signals for these.

During a printing process, controller 20 applies input electric power (total energy Ui) for ink ejection to each ejecting ink chamber to eject ink, via the electrodes, in accordance with image data while it supplies compensation power (energy U0), which will not causes ink ejection, to each of the non-ejecting ink chambers other than the ejecting ink chambers. This compensation power is defined to be the electric power to be converted into thermal energy in the non-ejecting ink chamber, causing temperature rise as high as the differential energy obtained by subtracting the thermal energy (energy Ud) discharged accompanying the droplets of ink ejected to the outside from the thermal energy (total energy Ui) or the input power supplied via the electrodes to the ejecting ink chambers, does.

More specifically, the total power imparted to the whole ink chambers, denoted as Pw, is obtained as $$Pw=W0+(WF-W0)\times FR,$$

(Pw becomes equal to the input power WF when the ejection ratio is 100%), the dot calorie Wd carried away by the ink droplets ejected from the ejecting ink chambers is obtained as $$Wd=Wo\times FR\times\Delta T,$$

and the quantity of discharged heat, Wf, discharged from the outer surface of ink-jet head 11 is represented as $$Wf=\Delta T/Rt,$$

where Wo(W/deg) is the value of the energy discharged to the outside when all nozzles eject ink droplets, per unit temperature of the difference to the external air; W0 is the compensation power imparted to all ink chambers when no nozzles eject ink; FR is the ejection ratio defined as the ratio of the number of the ejecting nozzles to the number of all nozzles; WF is the input electric power when the ejection ratio is 100%; ΔT is the increase in temperature of ink; and Rt(deg/W) is the heat resistance to heat radiation.

Here, the kinetic energy, surface energy and the energy consumed due ink viscosity of the ink droplets ejected from the ejecting ink chambers are sufficiently small compared to the energy used for generation of heat in the ejecting ink chambers. Therefore, when the temperature rise of ink-jet head 11 has become saturated, Pw, i.e., the total power imparted to the whole ink chambers can be assumed to be consumed by the quantity of discharged heat Wf from ink-jet and the dot calorie Wd carried away by the ink droplets ejected from the ejecting ink chambers, so that Pw=Wf+Pd.

Accordingly, the temperature rise ΔT can be written as:

$$\Delta T=(W0+(WF-W0)\times FR)/(1/Rt+Wo\times FR)=W0\times Rt\times(1+FR(WF-W0)/W0)/(1+Rt\times Wo\times FR).$$

To leave out the dependency of the temperature rise ΔT on the ejection ratio FR, $$(1+FR(WF-W0)/W0)=(1+Rt\times Wo\times FR)$$

should hold. This equation can be rewritten as $$W0=WF/(1+Wo\times Rt).$$

When N represents the total number of ink droplets ejected per second in the whole ink-jet head when ink is ejected from all ink chamber in ink-jet head 11, the energy U0 to be imparted to each non-ejecting ink chamber for one ejection of ink droplet is written as $$U0=W0/N=WF/(1+Wo\times Rt)/N.$$

Here, since the heat resistance to heat radiation, Rt, can be roughly evaluated by the performance when the elevated temperature of ink-jet head 11 is released from the surface of ink-jet head 11 to the air, it can be determined based on the values of actual measurement on the input power and temperature rise when no ink is ejected from any of the nozzles.

The energy discharged to the outside with the ink droplets when ink is ejected from all nozzles, per unit temperature of the difference between the temperature inside the apparatus and the temperature of ink-jet head 11, represented by Wo(W/deg), can be obtained as $$Wo=C\cdot\gamma\cdot V,$$

where C(J/(g·deg)) is the specific heat of the ink, γ(g/cc) is the specific weight and V(cc/sec) is the total flow amount of ink when ink is ejected from all nozzles. Because the temperature inside the apparatus is approximately equal to the temperature of ink flowing into the ink chambers and the temperature of ink-jet head 11 is approximately equal to the temperature of the ejected ink droplets. Accordingly, the energy U0 to be imparted to each non-ejecting ink chamber when a droplet ink is ejected from each ejecting ink chamber can be obtained as $$U0=WF/(1+C\cdot\gamma\cdot V\cdot Rt)/N.$$

FIGS. 4A, 4B and 4C and FIGS. 5A, 5B and 5C are charts for explaining the control method of the ink-jet head and the way the temperature of the ink-jet head rises in the ink-jet printer according to the embodiment of the present invention, in comparison with other control methods. Here, the values of input power Pi in the charts denote the values of electric power supplied to the whole ink-jet head 11 in accordance with the ejection ratios FR. Here, discussion will be made as to a configuration where the input power WF when all the nozzles on ink-jet head 11 eject ink at the maximum frequency (corresponding to an ejection ratio FR of 100%) is 5 W, the heat resistance to radiation Rt when heat is naturally discharged to the outside from ink-jet head 11 is 15 (deg/W), and the discharged energy ratio of ink droplets, Wo, is 0.19 (W/deg).

Figure 5A:
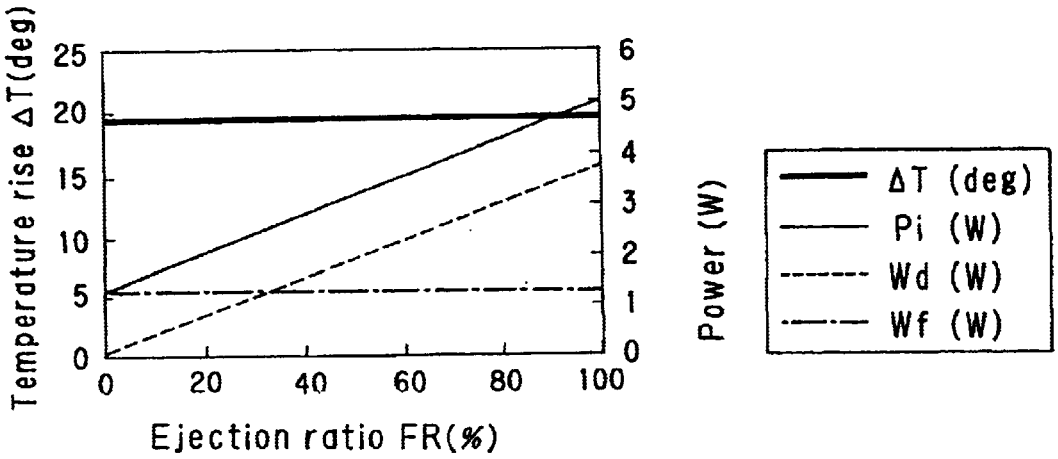
Figure 5B:
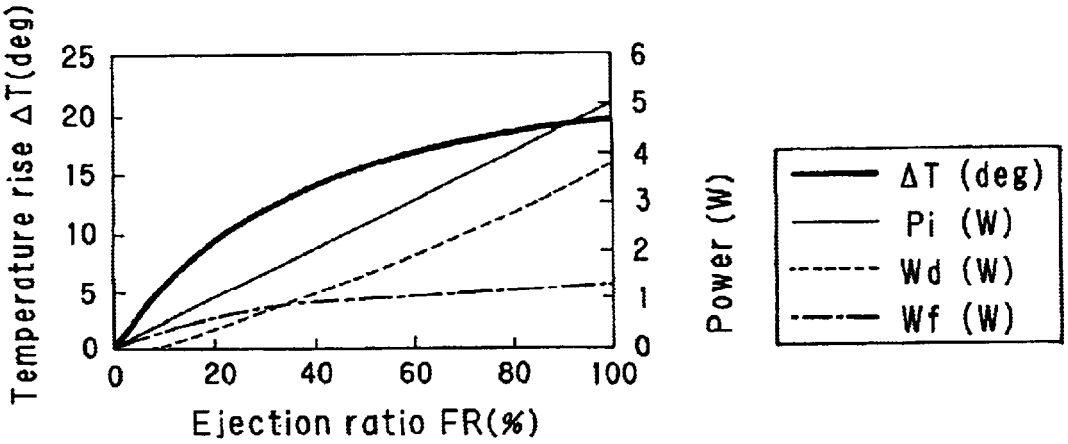
FIG. 5B CONVENTIONAL ART

To begin with, as shown in FIGS. 4B and 5B, in a conventional drive method where no compensation power is applied to non-ejecting ink chambers, an amount of electric power necessary for ink ejection is applied to each ejecting ink chamber only and part of it is lost. Therefore, the temperature rise ΔT of ink-jet head 11 relative to the ambient temperature will increase as the ejection ratio increases. In this example, a temperature rise of 20 degrees occurs. This means that the temperature of ink-jet head 11 may range from its ambient temperature, minimum, to that plus 20 degrees, depending on the image content to be printed.

In contrast to this, the ink-jet printer 1 according to the embodiment of the present invention, as shown in FIGS. 4A and 5A, a fixed amount of electric power which will not cause ink ejection is applied to each non-ejecting ink chamber to generate a desired amount of power consumption, whereby all the ink chambers, whether ink is ejected or not, can be uniformly elevated in temperature. This means that imbalance in temperature distribution across the ink chamber array in ink-jet head 11 and variation in temperature depending on time as printing proceeds can be prevented.

In this example where 384 nozzles each producing 6000 ink droplets per second, maximum, were used, the expected result can be achieved by applying a compensation power of 0.56 $\mu$J to each non-ejection chamber per ejection cycle. Electric power to be applied to ink-jet head 11 when none of ink chambers ejects ink is 1.3 W.

Figure 5C:
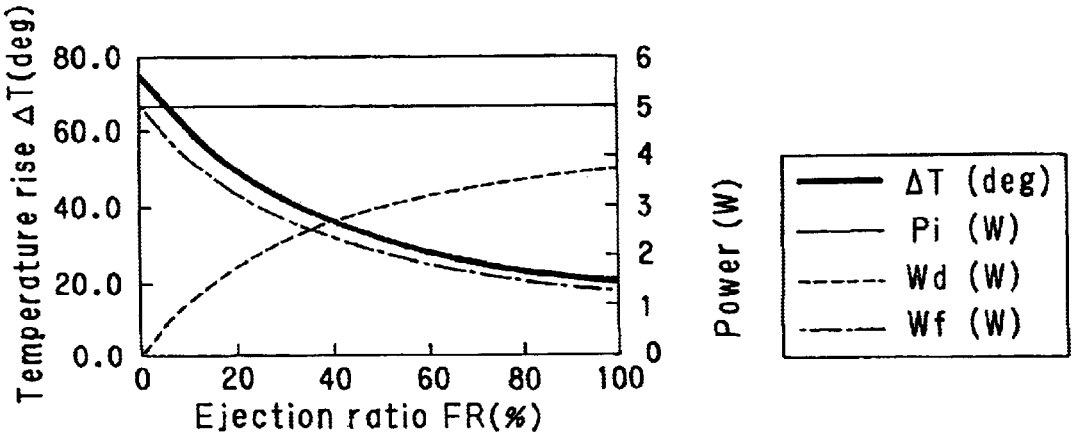

FIGS. 4C and 5C show a case where too much power is applied to the non-ejecting ink chambers.

In connection with the above description, the input power referred to in an ink-jet head of a piezoelectric type is the difference between the electric power injected to the piezoelectric element from the drive circuit when the piezoelectric elements is charged and the electric energy released from the piezoelectric element and collected by the drive circuit when the piezoelectric element releases electricity. The input power referred to in an ink-jet head of a thermal type is the electric power injected to the heat element from the drive circuit.

In the above embodiment, through description has been made taking an example of a piezoelectric type ink-jet printer, the present invention can be similarly applied to a thermal type ink-jet printer in which electric energy imparted to the ink-jet head is converted into thermal energy to heat ink in ink chambers so as to cause ink to eject from the ink chambers.

According to the present invention, the following effects can be obtained.

According to the present invention, upon ejection of ink from ejecting ink chambers to print an image, an amount of energy U0, the difference obtained by subtracting energy Ud carried away by one ejected ink droplet from energy Ui imparted to each ejecting ink chamber, is imparted to each of the non-ejecting ink chambers. Thus, the energy U0 equal to the energy (Ui−Ud) consumed to heat ink in each ejecting ink chamber is imparted to each non-ejecting ink chamber when an action of ejection is made, so that ink inside the non-ejection chambers can be elevated in temperature as much as the increase in temperature inside the ejecting ink chambers, whereby it is possible to make the ink ejection performance as to all ink chambers provided for the ink-jet head uniform and hence positively prevent degradation of the image quality of printed images.

According to the present invention, a value of the energy U0 to be imparted to each non-ejecting ink chamber upon an action of ink ejection can be calculated using designated arithmetic operations based on the thermal resistance of the ink-jet head, the specific heat of the ink, the specific weight of the ink, the amount of ink ejection, the number of ink droplets ejected from the whole ink-jet head for one second and the power consumption during this period, obtained when all the ink chambers provided for the ink-jet head are caused to eject ink. That is, the energy to be imparted to each non-ejecting ink chamber upon an action of ink ejection can be optimized in terms of heat balance, based on the power consumption and the total number of ink droplets ejected for one second when all the ink chambers are caused to eject ink. Accordingly, the ink ejection performance in all ink chambers provided for the ink-jet head, can be kept substantially uniform no matter whether ink is ejected or not, when ink is ejected, whereby it is possible to positively prevent degradation of the image quality of printed images.

According to the present invention, in a thermal type ink-jet head which converts electric energy imparted to each ink chamber into thermal energy so as to heat ink charged in the ink chamber, an amount of heat energy equal to the heat energy used for heating ink in the ejecting ink chamber upon an action of ink ejection, is imparted to each non-ejecting ink chamber, whereby it is possible to increase the temperature of the ink in each non-ejecting ink chamber as much as the ink in ejecting ink chambers. As a result, it is possible to keep the ink ejection performance substantially uniform for all the ink chambers provided for the ink-jet head and positively prevent degradation of the image quality of printed images.

According to the present invention, in a piezoelectric type ink-jet head which converts electric energy imparted to each ink chamber into mechanical energy so as to change the volume of the ink chamber by deformation of the piezoelectric element, an amount of energy equal to the energy which will cause a temperature rise of the piezoelectric element in each ejection chamber upon an action of ink ejection, is imparted to each non-ejecting ink chamber, whereby it is possible to cause the piezoelectric element in each non-ejecting ink chamber to generate as much heat as the piezoelectric element provided in each ejecting ink chamber does, hence it is possible to heat the ink in each non-ejecting ink chamber in an equivalent way to the way in which the ink in each ejecting ink chamber is heated. As a result, it is possible to keep the ink ejection performance substantially uniform for all the ink chambers provided for the ink-jet head and positively prevent degradation of the image quality of printed images.

According to the present invention, in a multi-drop type ink-jet head which is liable to cause remarkable temperature difference in ink temperature between the ejecting ink chambers and the non-ejecting ink chambers upon an action of ink ejection, an amount of heat energy equal to the energy used for heating ink in the ejecting ink chamber upon an action of ink ejection, is imparted to each non-ejecting ink chamber, whereby it is possible to prevent excessive increase in temperature difference between the ejecting ink chambers and the non-ejecting ink chambers upon ejection of ink. As a result, it is possible to keep the ink ejection performance substantially uniform for all the ink chambers provided for the ink-jet head and positively prevent degradation of the image quality of printed images.

According to the present invention, when, among the multiple ink chambers arranged adjoining an ink-jet head, energy is imparted to ejecting ink chambers selected in accordance with image data, an amount of energy U0, the difference obtained by subtracting energy Ud carried away by the ejected ink droplet from energy Ui imparted to each ejecting ink chamber, is imparted to each of the non-ejecting ink chambers other than the ejecting ink chambers. Thus, the energy U0 equal to the energy (Ui−Ud) consumed to heat ink in each ejecting ink chamber is imparted to each non-ejecting ink chamber when an action of ejection is made, so that ink inside the non-ejection chambers can be elevated in temperature as much as the increase in temperature inside the ejecting ink chambers, whereby it is possible to make the ink ejection performance, as to all ink chambers provided for the ink-jet head, uniform, and hence keep good image forming conditions.

What is claimed is:

1. A method of controlling an ink-jet head having a multiple number of ink chambers arranged adjacent thereto for forming images by selectively imparting energy to each of the ink chambers in accordance with image data so as to cause ink charged in the ink chambers to eject, characterized in that an amount of energy U0, which is determined by $$U0=Ui-Ud,$$

is imparted to each of non-ejecting ink chambers for one ink ejection cycle, where Ui is the energy to be imparted to each ejecting ink chamber that ejects ink, every ink ejection cycle, among the multiple ink chambers, and Ud is the energy that is carried away by a single droplet of ink that is ejected to the outside when all the nozzles are driven to eject ink at the maximum ejection ratio with the temperature rise of the ink-jet head saturated.

2. The method of controlling an ink-jet head according to claim 1, wherein the energy U0 can be determined as $$U0\approx WF/(1+C\cdot\gamma\cdot V\cdot Rt)/N,$$

and is imparted to each non-ejecting ink chamber every time ink is ejected from the ejecting ink chambers, where WF(W) is the input electric power when all ink chambers are caused to eject ink so that N ink droplets are ejected every second from the entire ink-jet head, C(J/(g·deg)) is the specific heat of the ink, γ(g/cc) is the specific weight of ink, V(cc/sec) is the amount of ejected ink and Rt(deg/W) is the heat resistance of the ink-jet head including radiator parts.

3. The method of controlling an ink-jet head according to claim 1, wherein the ink-jet head comprises a thermal type ink-jet head which ejects ink by converting the electric energy input to each ink chamber into thermal energy.

4. The method of controlling an ink-jet head according to claim 1, wherein the ink-jet head comprises a piezoelectric type ink-jet head which ejects ink by converting the electric energy input to each ink chamber into mechanical energy.

5. The method of controlling an ink-jet head according to claim 1, wherein drive energy is imparted to the ink chambers a number of times, up the specified maximum number, in accordance with image density data, during one cycle of a series of ink droplets.

6. An ink-jet printer comprising a controller, which controls an ink-jet head having a multiple number of ink chambers arranged adjacent thereto for forming images by selectively imparting energy to each of the ink chambers in accordance with image data so as to cause ink charged in the ink chambers to eject, and which implements a control method whereby an amount of energy U0, which is determined by $$U0=Ui-Ud,$$

is imparted to each of non-ejecting ink chambers for one ink ejection cycle, where Ui is the energy to be imparted to each ejecting ink chamber that ejects ink, every ink ejection cycle, among the multiple ink chambers, and Ud is the energy that is carried away by a single droplet of ink that is ejected to the outside when all the nozzles are driven to eject ink at the maximum ejection ratio with the temperature rise of the ink-jet head saturated.

* * * * *